US006726877B1

(12) United States Patent
Eccles

(10) Patent No.: US 6,726,877 B1
(45) **Date of Patent: *Apr. 27, 2004**

(54) SILVER ALLOY COMPOSITIONS

(76) Inventor: Anthony Phillip Eccles, MS 424 Peachester Road, Beerwah, Queensland 4519 (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/637,802

(22) PCT Filed: Jun. 27, 1994

(86) PCT No.: PCT/AU94/00351

§ 371 (c)(1),
(2), (4) Date: May 8, 1996

(87) PCT Pub. No.: WO95/14112

PCT Pub. Date: May 26, 1995

(30) Foreign Application Priority Data

Nov. 15, 1993 (AU) ..... PM2432

(51) Int. Cl.[7] ..... C22C 5/10
(52) U.S. Cl. ..... 420/504; 420/502; 148/430
(58) Field of Search ..... 420/502, 503, 420/590, 504; 148/430

(56) References Cited

U.S. PATENT DOCUMENTS

| | | | | | |
|---|---|---|---|---|---|
| 1,614,752 | A | | 1/1927 | Mitchell | |
| 1,643,304 | A | | 9/1927 | Korsunsky | |
| 1,720,894 | A | | 7/1929 | Gray et al. | |
| 1,970,319 | A | | 8/1934 | Kern | |
| 2,052,142 | A | | 8/1936 | Kern | |
| 3,811,876 | A | * | 5/1974 | Harigaya et al. | 420/504 |
| 4,124,380 | A | | 11/1978 | Youdelis | |
| 4,973,446 | A | * | 11/1990 | Bernhard et al. | 420/504 |
| 5,039,479 | A | | 8/1991 | Bernhard et al. | |

FOREIGN PATENT DOCUMENTS

| | | | |
|---|---|---|---|
| EP | 641811 | * 11/1982 | |
| GB | 2255348 | 4/1992 | |
| JP | 52023660 | * 2/1977 | |
| JP | 56119747 | * 9/1981 | |
| JP | 57187195 | * 11/1982 | |
| JP | 60082635 | * 5/1985 | |
| JP | 61034144 | * 2/1986 | |
| JP | 61034147 | * 2/1986 | |
| JP | 61034148 | * 2/1986 | 420/504 |
| JP | 03087325 | * 4/1991 | |
| JP | 03170646 | * 7/1991 | |
| JP | 04224645 | * 8/1992 | |
| JP | 04339500 | * 11/1992 | |
| WO | WO 9622400 | * 7/1996 | |

OTHER PUBLICATIONS

Patent Abstracts of Japan, C39, p. 165, JP 55–138042, published Oct. 28, 1980.

* cited by examiner

*Primary Examiner*—John Sheehan
(74) *Attorney, Agent, or Firm*—Stephen E. Feldman, P.C.

(57) ABSTRACT

Silver alloys having properties of fire scale resistance, reduced porosity and oxide formation and reduced grain size relative to traditional sterling silver alloys and useful work hardening performance are provided, comprising about 80–99.0% by weight silver, about 0.5–6% by weight copper, about 0.02–7% by weight of a firescale resisting additive selected from one or a mixture of zinc and silicon, and about 0.01–2.5% by weight germanium. Master alloys for production of the above alloys are also provided for, having the general composition comprising, by weight, about 2.5–99.85% copper, about 0.1–35% zinc or silicon or mixtures thereof, and about 0.05–12.5% germanium.

11 Claims, No Drawings

SILVER ALLOY COMPOSITIONS

FIELD OF THE INVENTION

This invention relates to silver alloy compositions.

This invention has particular reference to sterling silver alloy compositions of silver content of at least 92.5% for jewelry, flatware, coinage and other applications where a work hardening alloy is required and for illustrative purposes reference will be made to this application. However, it is to be understood that this invention could be used to produce other types of silver alloys suitable for use as for example, electrical contacts or the like.

BACKGROUND OF THE INVENTION

In general, silver as a material for the production of silver jewelry, certain coinage and the like is specified to be sterling silver comprising at least 925 parts per thousand by weight fine silver and is specified as "0.925 silver". 0.925 silver accordingly typically comprises an alloy 92.5% by weight silver, generally alloyed with copper for hardness traces of other metals as additives or impurities.

Conventional silver alloys of the 0.925 type have several disadvantages in a manufacturing jewelry and other materials engineering contexts. Principal limitations include a characteristic firescale formation tendency attributable to oxidation of copper and other metals at the surface of cast or hot worked pieces. Additionally, traditional alloys have exhibited undesirable porosity in the recast metal and less than desirable grain size properties.

Several formulations have been proposed to overcome one or the other of the aforementioned disadvantages. U.S. Pat. Nos. 5,039,479 and 4,973,446 disclose alloys of silver and master alloys for the production of such silver alloys having superior qualities over conventional alloys, and including, in addition to silver, controlled amounts of copper and zinc, together with tin, indium, boron and silicon.

The compositions exhibit reduced porosity, grain size and fire scale production, and have acquired wide utilization in silver jewelry production. It is presumed but not established that the addition of zinc to such compositions provides at least a degree of antioxidant properties to the compositions when hot worked and improves colour, thus limiting the formation of principally copper oxide based fire scale, and reducing silver and copper oxide formation resulting in formation of pores in the cast or recast alloys. Silicon appears also to function as an antioxidant, thereby reducing firescale formation.

A disadvantage of the hereinbefore described firescale resisting alloys is that the alloys exhibit poor work hardening qualities thus not achieving the mechanical strength of traditional worked 0.925 silver goods.

DISCLOSURE OF THE INVENTION

The present invention aims to provide silver alloy compositions which substantially alleviate at least one of the foregoing disadvantages. A further object of the present invention is to provide silver alloys having the desirable properties of reduced fire scale, reduced porosity and oxide formation and reduced grain size relative to traditional sterling silver alloys whilst providing improved work hardening performance over the current firescale resistant alloys. Other objects and advantages of this invention will hereinafter become apparent.

With the foregoing and other objects in view, this invention in one aspect resides broadly in firescale resistant, work hardenable jewelry silver alloy compositions comprising:

0.5–6% by weight copper;

0.02–7% by weight of a firescale resisting additive selected from one or a mixture of zinc and silicon, and 0.01–2.5% by weight germanium.

The silver content of the alloy may be selected to be in the amounts commonly specified for grading silver. For example, the alloy may comprise from about 89 to 95% by weight silver. Preferably, the alloy contains a proportion of silver required for the graded application to which the alloy is to be put, such as 0.925 silver, that is at least 92.5% by weight, for sterling silver applications and at least 90% by weight for coinage.

The copper content of the alloy may be selected according to the hardness required of the cast alloy. For example, for manufacturing jewelers, 0.925 alloy, the copper content may advantageously be in the range of from about 2.0 to 3.0% by weight.

The zinc content of the alloy has a bearing on the colour of the alloy as well as functioning as a reducing agent for silver and copper oxides. Preferably, the amount of zinc used is selected to be between about 2.0 and 4.0% by weight. The silicon content of the alloy is preferably adjusted relative to the proportion of zinc used to provide the desired firescale resistance whilst maintaining a suitable colour commensurate with the zinc content of the alloy, and may for example advantageously fall within the range of about 0.15 to 0.2% by weight.

The germanium content of the alloy has surprisingly resulted in alloys having work hardening characteristics of a kind with those exhibited by conventional 0.925 silver alloys, together with the firescale resistance of the hereinbefore described firescale resistant alloys. In general, it has been determined that amounts of germanium in the alloy of from about 0.04 to 2.0% by weight provide modified work hardening properties relative to alloys of the firescale resistant kind not including germanium. However, it is noted that the hardening performance is not linear with increasing germanium nor is the hardening linear with degree of work.

Preferably, the alloy also includes rheology modifying and other additives to aid in improving the castability and/or wetting performance of the molten alloy. For example, about 0.0 to 3.5% by weight of a modifying additive selected from one or a mixture of indium and boron may be advantageously added to the alloy to provide grain refinement and/or reduce surface tension, thereby providing greater wettability of the molten alloy. Where used, preferably the amount of boron utilized in the composition is from about 0 to 2% by weight boron and/or about 0 to 1.5% by weight indium. Other alloying elements may be added such as gold, tin or platinum. Where tin is included in the composition, this may be advantageously used up to about 6% by weight, and is preferably utilized in an amount of from about 0.25 to 6%.

Accordingly, in a further aspect, this invention resides in silver alloy compositions including:

81–99.409% by weight silver;

0.5–6% by weight copper;

0.05–5% by weight zinc;

0.02–2% by weight silicon;

0.001–2% by weight boron;

0.01–1.5% by weight indium, and 0.01–2.5% by weight germanium.

In a further aspect, this invention resides in silver alloy compositions including:

75–99.159% by weight silver;

0.5–6% by weight copper;

0.05–5% by weight zinc;

0.02–2% by weight silicon;

0.001–2% by weight boron;

0.01–1.5% by weight indium;

0.01–2.5% by weight germanium, and 0.25–6.0% by weight tin.

Of course, it is of advantage to the manufacturing metallurgist to be able to alloy fine silver without having to individually measure components. Accordingly, it is preferred that the compositions of the present invention be formed by the addition of a master alloy to fine silver. This also has the advantage that the master alloys are easier to transport than the made up alloys. Additionally, oxidizable components of the alloy are more stable to atmospheric oxidation when alloyed. Accordingly, in a further aspect this invention resides broadly in a method of producing firescale resistant, work hardenable silver alloy compositions and including the alloying of silver metal with a master alloy comprising, by weight:

52.5–99.85% by weight copper;

0.1–35% by weight of zinc or silicon or mixtures thereof, and 0.05–12.5% by weight germanium.

For production of the preferred modified alloys, there may be provided master alloys including additional alloying elements such as up to about 10% by weight boron, up to about 15% by weight indium and/or up to about 30% by weight tin. Accordingly, in a preferred aspect this invention resides in a method of producing firescale resistant, work hardenable silver alloy compositions including the alloying of silver metal with a master alloy comprising, by weight:

15.0–99.545% by weight copper;

0.25–25% by weight zinc;

0.1–10% by weight silicon;

0.005–10% by weight boron;

0.05–15% by weight indium, and 0.05–25% by weight germanium.

In a yet further aspect this invention resides in a method of producing firescale resistant, work hardenable silver alloy compositions including the alloying of silver metal with a master alloy comprising, by weight:

2.5–97.455% by weight copper;

0.25–25% by weight zinc;

0.1–10% by weight silicon;

0.005–10% by weight boron;

0.05–15% by weight indium;

0.05–25% by weight germanium, and 2.0–12.5% by weight tin.

In a yet further aspect this invention resides in a method of producing firescale resistant, work hardenable silver alloy compositions including the alloying of silver metal with a master alloy comprising, by weight:

2.5–97.455% by weight copper;

0.25–19.85% by weight zinc;

0.1–7.94% by weight silicon;

0.005–7.94% by weight boron;

0.05–11.92% by weight indium;

0.05–19.85% by weight germanium, and 2.0–30% by weight tin.

In order that this invention may be more readily understood and put into practical effect, reference will now be made to the following example which describes a preferred embodiment of the invention.

EXAMPLE 1

An alloy consisting of the following constituents (by weight) and being in accordance with U.S. Pat. No. 5,039,479 was provided as a first control:

| | |
|---|---|
| silver | 92.5% |
| copper | 3.29% |
| zinc | 3.75% |
| indium | 0.25% |
| boron | 0.01% |
| silicon | 0.2% |

This alloy is known as and will be referred to hereinafter as "UPM alloy". As a second control, a commercial sterling silver was used, comprising 92.5% by weight silver and the balance mainly copper.

Samples of the controls were cast and the hardness of each were measured as cast, at 50% and 75% work and annealed, according to the Vickers hardness VH scale. As used hereinafter the terms "50% work" and "75% work" mean subjecting a cast sample to cold rolling to 50% and 25% of its original thickness respectively.

Three alloys A to C in accordance with the present invention were prepared to the following compositions:

| | ALLOY A | ALLOY B | ALLOY C |
|---|---|---|---|
| Ag | 92.5 | 92.5 | 92.5 |
| Cu | 2.35 | 3.25 | 3.0 |
| Zn | 2.82 | 3.75 | 3.14 |
| Si | 0.19 | 0.2 | 0.15 |
| B | 0.01 | 0.01 | 0.01 |
| In | 0.23 | 0.25 | 0.2 |
| Ge | 1.9 | 0.04 | 1.0 |

The three alloys were cast into samples as per the controls and were tested for Vickers Hardness as cast, at 50% and 75% work and annealed. The hardness results for the controls and alloys A, B, and C are as follows:

| ALLOY | VH AS CAST | VH @ 50% WORK | VH @ 75% WORK | VH ANNEALED |
|---|---|---|---|---|
| STERLING | 75.4 | 133 | 150 | 59 |
| UPM | 67 | 135 | 153 | 58.3 |
| A | 70.2 | 146 | 150 | 59.6 |
| B | 72.4 | 135 | 143 | 61.3 |
| C | 77.2 | 123 | 159 | 63.6 |

It can be seen that the alloy B having only 0.04% by weight Ge is harder than UPM and softer than sterling when cast, but that all three alloys are on par at 50% work. Alloy B exhibited a softening relative to the controls at 75% work and is hardest relative to the controls when annealed. Alloy C, having 1.0% by weight Ge, exhibits an as-cast hardness on par with sterling, is softer than UPM or sterling at 50% work, but is markedly harder than these two alloys at 75% work. Alloy A, having 1.9% by weight Ge, exhibits as-cast hardness between that of UPM and sterling, is markedly harder than these two alloys at 50% work, but does not increase hardness as much as the controls upon further work to 75%.

EXAMPLE 2

A firescale resistant, work hardening 925 silver alloy was prepared in accordance with the following formula, expressed as percentages by weight:

| | |
|---|---|
| Zinc | 2.25 |
| Indium | 0.075 |
| Tin | 0.075 |
| Germanium | 0.125 |
| Boron | 0.003 |
| Silicon | 0.20 |
| Copper | 4.772 |
| Silver | 92.50 |

This alloy exhibited an as-cast Vickers hardness of approximately 15% greater than the firescale resistant alloy prepared without addition of germanium.

In use, alloys in accordance with the above embodiments and in accordance with the present invention may be selected by tailoring the germanium content of the alloys to provide the desired work hardening characteristics. The non-linear effect of use of germanium and the ability to vary other elements such as copper provides for production of a range of firescale resistant alloys of selected as-cast hardness and work hardenability.

It will of course be realised that while the above has been given by way of illustrative example of this invention, all such and other modifications and variations thereto as would be apparent to persons skilled in the art are deemed to fall within the broad scope and ambit of this invention as defined in the claims appended hereto.

What is claimed is:

1. A fire scale resistant, work hardenable jewelry silver alloy composition comprising:

at least 86% by weight silver;

0.5–7.5% by weight copper 0.07–6% by weight of a mixture of zinc and silicon wherein said silicon is present in an amount of from about 0.02 to about 2.0% by weight; and from about 0.01 to no more than 2.0% by weight germanium, wherein an increase in the amount of geranium does not result in linear hardening performance and that hardening is non-linear with the degree of work.

2. The silver alloy composition of claim 1 wherein said silver is present in an amount at least 92.5% by weight.

3. The silver alloy composition of claim 1 wherein said copper is present in an amount of from about 2.0 to about 4.0% by weight.

4. The silver alloy composition of claim 1 that includes zinc in an amount of from about 2.0 to about 4.0% by weight.

5. The silver alloy composition of claim 1 wherein said germanium is present in an amount of from about 0.04 to no more than 2.0% by weight.

6. The silver alloy composition of claim 1 that includes an additive selected from the group consisting of indium, boron and a mixture of indium and boron in an amount of up to about 3.5% by weight.

7. The silver alloy composition of claim 6 wherein said mixture comprises up to about 2% by weight boron and up to about 1.5% by weight indium.

8. The silver alloy composition of claim 1 that includes tin amount up to about 6% by weight.

9. The silver alloy composition of claim 8 wherein said tin is present in an amount of from about 0.25 to about 6% by weight.

10. A fire scale resistant, work hardenable jewelry silver alloy composition comprising:

81–95.409% by weight silver;

0.5–6% by weight copper;

0.05–5% by weight zinc;

0.02–2% by weight silicon;

0.01–2% by weight boron;

0.01–1.5% by weight indium; and, 0.01–no more than 2.0% by weight germanium, wherein an increase in the amount of germanium does not result in linear hardening performance and that hardening is non-linear with the degree of work.

11. A fire scale resistant, work hardenable jewelry silver alloy composition comprising:

75–99.159% by weight silver;

0.5–6% by weight copper;

0.05–5% by weight zinc;

0.02–2% by weight silicon;

0.01–2% by weight boron;

0.01–1.5% by weight indium;

0.25–6% by weight tin; and, 0.01–no more than 2% by weight germanium, wherein an increase in the amount of germanium does not result in linear hardening performance and that hardening is non-linear with the degree of work.

* * * * *

US006726877C1

(12) EX PARTE REEXAMINATION CERTIFICATE (5830th)

United States Patent

Eccles

(10) Number: US 6,726,877 C1

(45) Certificate Issued: Jul. 24, 2007

(54) SILVER ALLOY COMPOSITIONS

(75) Inventor: Anthony Phillip Eccles, Beerwah (AU)

(73) Assignee: Apecs Investment Castings Pty, Ltd., Burwood (AU)

Reexamination Request:
No. 90/007,548, May 19, 2005

Reexamination Certificate for:

| | |
|---|---|
| Patent No.: | **6,726,877** |
| Issued: | **Apr. 27, 2004** |
| Appl. No.: | **08/637,802** |
| Filed: | **May 8, 1996** |

(22) PCT Filed: Jun. 27, 1994

(86) PCT No.: PCT/AU94/00351

§ 371 (c)(1), (2), (4) Date: May 8, 1996

(87) PCT Pub. No.: WO95/14112

PCT Pub. Date: May 26, 1995

(51) Int. Cl.
*C22C 5/06* (2006.01)
*C22C 5/08* (2006.01)

(52) U.S. Cl. ..... 420/504; 420/502; 148/430

(58) Field of Classification Search ..... None
See application file for complete search history.

(56) References Cited

U.S. PATENT DOCUMENTS 5,039,479 A 8/1991 Bernhard et al.

FOREIGN PATENT DOCUMENTS

GB 2255348 A 4/1992

OTHER PUBLICATIONS

Chapter 9, , E. B.Weglein, Silver, Economics, Metallurgy and Use, Edited by Allison Butts with Charles D. Coxe, D. Van Nostrand Company Inc., Princeton, New Jersey, 1967.

*Primary Examiner*—Kiley Stoner

(57) ABSTRACT

Silver alloys having properties of fire scale resistance, reduced porosity and oxide formation and reduced grain size relative to traditional sterling silver alloys and useful work hardening performance are provided, comprising about 80–99.0% by weight silver, about 0.5–6% by weight copper, about 0.02–7% by weight of a firescale resisting additive selected from one or a mixture of zinc and silicon, and about 0.01–2.5% by weight germanium. Master alloys for production of the above alloys are also provided for, having the general composition comprising, by weight, about 2.5–99.85% copper, about 0.1–35% zinc or silicon or mixtures thereof, and about 0.05–12.5% germanium.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–11 is confirmed.

* * * * *